US006588666B1

(12) United States Patent
Sacchetti et al.

(10) Patent No.: US 6,588,666 B1
(45) Date of Patent: Jul. 8, 2003

(54) APPARATUS FOR OPENING AND DISPENSING PLASTIC BAGS

(76) Inventors: Alfred D. Sacchetti, 1903 Sharon Rd., Meadowbrook, PA (US) 19046; Angelo C. Romano, 345 Gingo Dr., Blue Bell, PA (US) 19422

( * ) Notice: Subject to any disclaimer, the term of this patent is extended or adjusted under 35 U.S.C. 154(b) by 9 days.

(21) Appl. No.: 10/020,608

(22) Filed: Dec. 18, 2001

(51) Int. Cl.[7] ..... G06K 7/10

(52) U.S. Cl. ..... 235/462.01; 235/462.13; 53/384.1

(58) Field of Search ..... 235/462.01, 375, 235/383, 385, 442, 462.13; 901/9, 13, 41; 53/29, 64, 384.1

(56) References Cited

U.S. PATENT DOCUMENTS 3,783,580 A * 1/1974 Raudys ..... 53/459
3,961,460 A * 6/1976 Jelling et al. ..... 53/64
3,987,603 A * 10/1976 Jelling et al. ..... 53/459
3,990,625 A * 11/1976 Jelling et al. ..... 206/459.5
4,025,383 A * 5/1977 Ferrigno ..... 156/530
4,597,240 A * 7/1986 Scully ..... 53/57
4,694,638 A * 9/1987 Maddux et al. ..... 53/459
5,191,749 A * 3/1993 Cappi et al. ..... 53/502
5,341,625 A * 8/1994 Kramer ..... 53/459

FOREIGN PATENT DOCUMENTS

GB WO 15515 A1 * 9/2000

* cited by examiner

*Primary Examiner*—Thien M. Le
*Assistant Examiner*—Daniel Walsh
(74) *Attorney, Agent, or Firm*—Zachary T. Wobensmith, III

(57) ABSTRACT

Apparatus for opening and dispensing plastic bags which includes an outer cabinet with a continuous roll of plastic bags fed therethrough, with seal lines and perforation lines between the bags, and bar codes thereon, which bags may be dispensed by the user pulling on an exposed bag, which causes the bag inside the housing to move in front of a bar code reader which activates a clamping device and fingers to pre-open the bags and an air blast is provided outside the cabinet to open the exposed bag, which is outside of the cabinet. The user then pulls off the exposed opened bag at the perforations. The apparatus can also automatically dispense the bags when the customer activates the apparatus.

6 Claims, 12 Drawing Sheets

CLAMP "DOWN"

CLAMP "UP"

APPARATUS FOR OPENING AND DISPENSING PLASTIC BAGS

BACKGROUND OF THE INVENTION

1. Field of the Invention

This invention relates to apparatus which pre-opens and dispenses plastic bags from a continuous roll of plastic bags, which bags have seal lines, and perforation lines between them, with bar code indicia thereon, and which are fed through the apparatus and sensed by a bar code reader. The bag is pre-opened inside the apparatus, and may be manually pulled out one at a time by the user, whereupon the bag is fully opened by a blast of air, and then separated at the remaining perforation for removal and use, and which bags can be automatically dispensed by customer activation of an alternate embodiment of the apparatus.

2. Description of the Prior Art

The use of thin plastic bags to contain produce and other items is widespread in grocery and other stores.

These bags are of plastic film, and commonly provided on continuous perforated rolls from which a user pulls down a bag, tears it off at a perforation line, and then manually opens the end of the bag for use. The bags when removed are closed or folded. The plastic has a tendency to be electrically charged which causes the top and under side of the bag to stick or adhere together, which problem is compounded upon tearing of the bag as the ruptured perforations tend to stick together.

The customer typically wets his or her finger tips with saliva, touches the bag and opens the end. The customer then touches the food or produce and places the selected items in the bag. The customer is likely to contaminate the food items handled but not selected, spreading germs for other customers to contact.

Even with wetting the fingertips, the customer is often unable to open the bags and many are wasted.

Most of the prior art apparatus dispense bags in the closed condition, and examples of such apparatus are shown or described in the U.S. Patents to Heckrodt, U.S. Pat. No. 3,826,361; Kinard U.S. Pat. No. 4,177,726; Leider U.S. Pat. No. 4,182,094; Johnson U.S. Pat. No. 4,795,413; Horning U.S. Pat. No. 5,007,171; Simhaee U.S. Pat. No. 5,135,146; Simhaee U.S. Pat. No. 5,261,585; Daniels U.S. Pat. No. 5,480,084; Morris U.S. Pat. No. 5,556,019; and Simaee U.S. Pat. No. 5,558,262. In our prior application Ser. No. Pct/US98/05796 apparatus for opening and dispensing plastic bags is described, which while operational, suffers from pre-opening shortcomings due to its use of a linear actuator.

The apparatus of the invention, which does not suffer from prior art shortcomings clamps and pre-opens the bags while they are inside its cabinet, and fully opens a bag on the outside by a blast of air when pulled down by the customer, and if desired, the apparatus can automatically dispense fully opened bags upon the customers' activating the apparatus.

SUMMARY OF THE INVENTION

This invention relates to apparatus for opening and dispensing plastic bags, which includes a cabinet wherein individual bags are fed from a continuous roll of bags, with seal lines and perforation lines therebetween, which bags carry bar code indicia which are sensed by a bar code reader, which causes a bag to be clamped and pre-opened. The bag is then manually or, automatically dispensed, is fully opened by an airblast, and then pulled off by the customer for use.

The principal object of the invention is to provide apparatus for opening and dispensing plastic bags, from a roll of bags.

A further object of the invention is to provide apparatus that manually or automatically opens and dispenses plastic bags.

A further object of the invention is to provide apparatus which is useful for dispensing a variety of lengths of plastic bags.

A further object of the invention is to provide apparatus which is simple and convenient to use.

A further object of the invention is to provide apparatus which is economical to operate.

A further object of the invention is to provide apparatus whose use promotes public health.

A further object of the invention is to provide apparatus which has improved pre-opening mechanism, and is durable in use.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
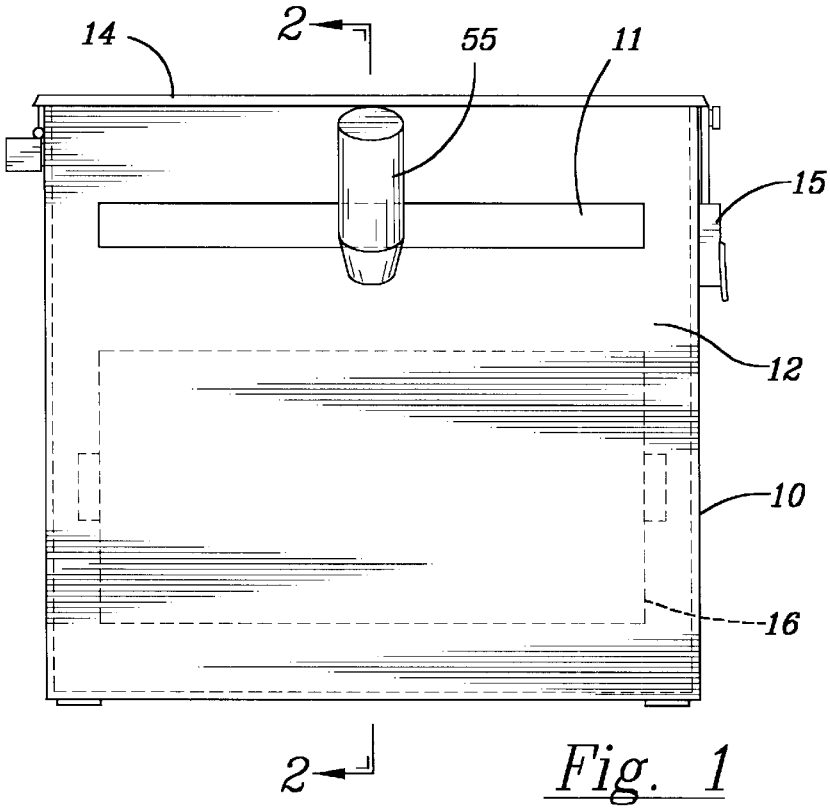
FIG. 1 is a front elevational view of the apparatus of the invention in partial phantom.
Figure 1A:
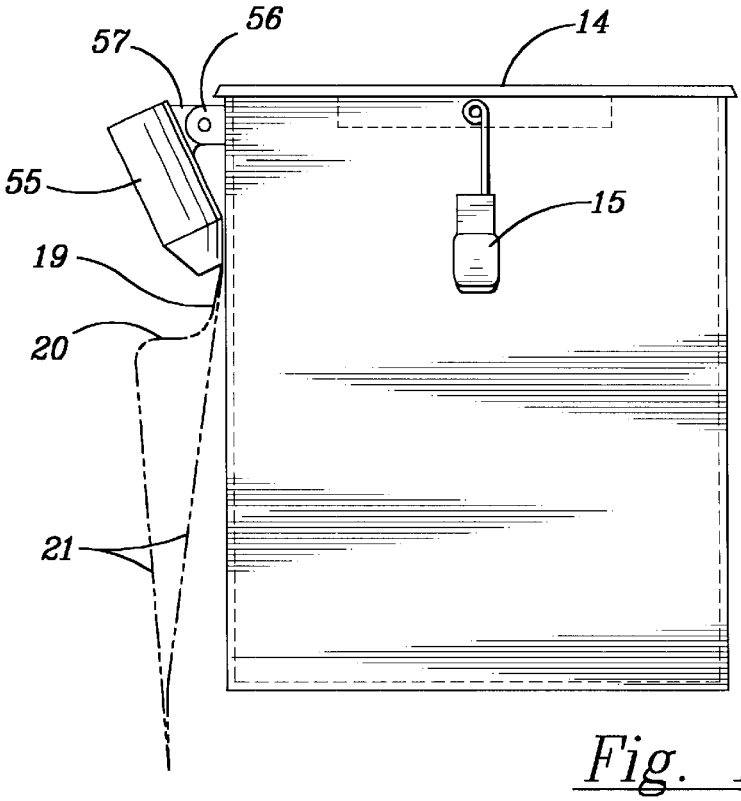
FIG. 1A is a right side elevational view of the apparatus of FIG. 1.
Figure 2:
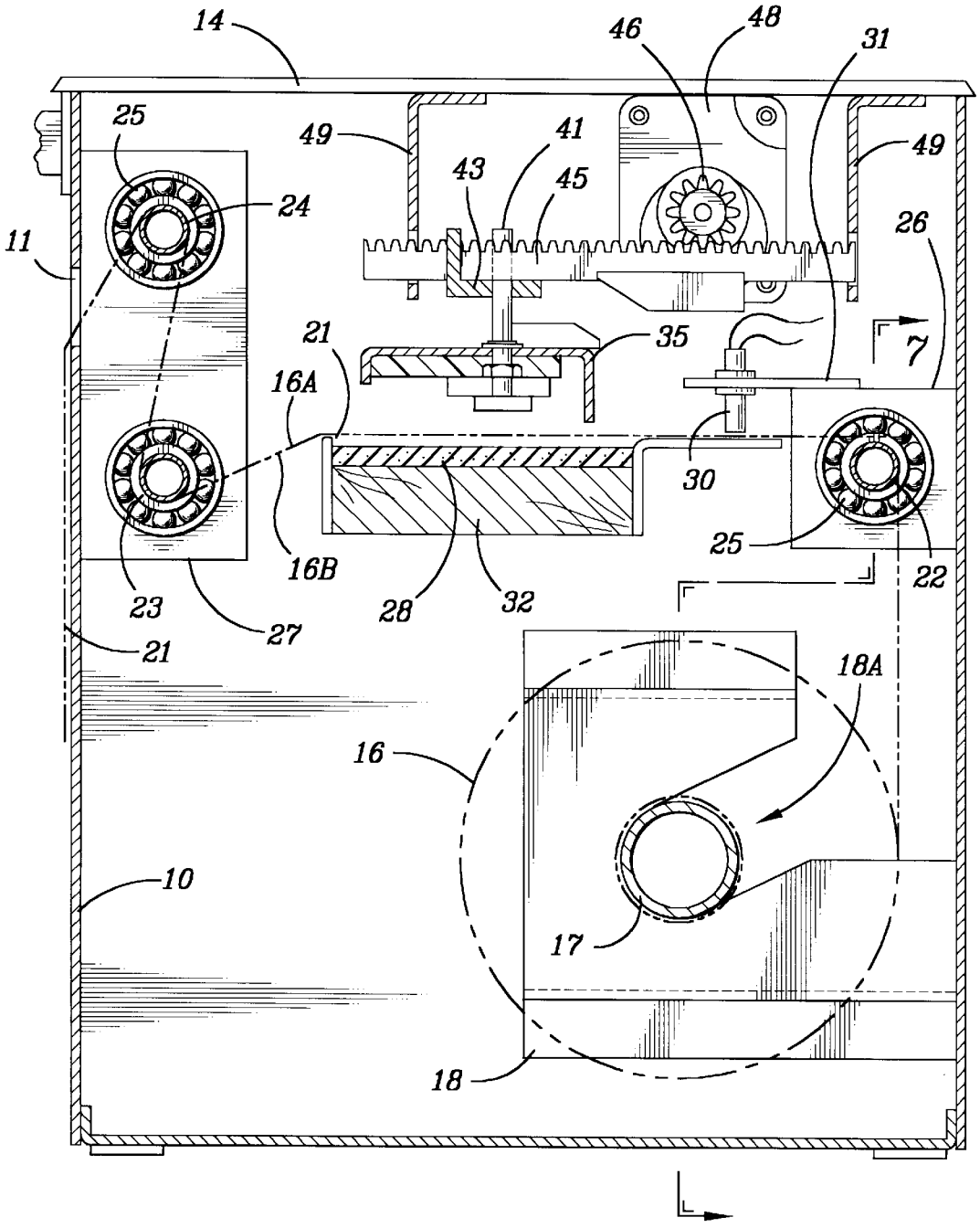
FIG. 2 is a vertical sectional view taken approximately on the Line 2—2 of FIG. 1.
Figure 3:
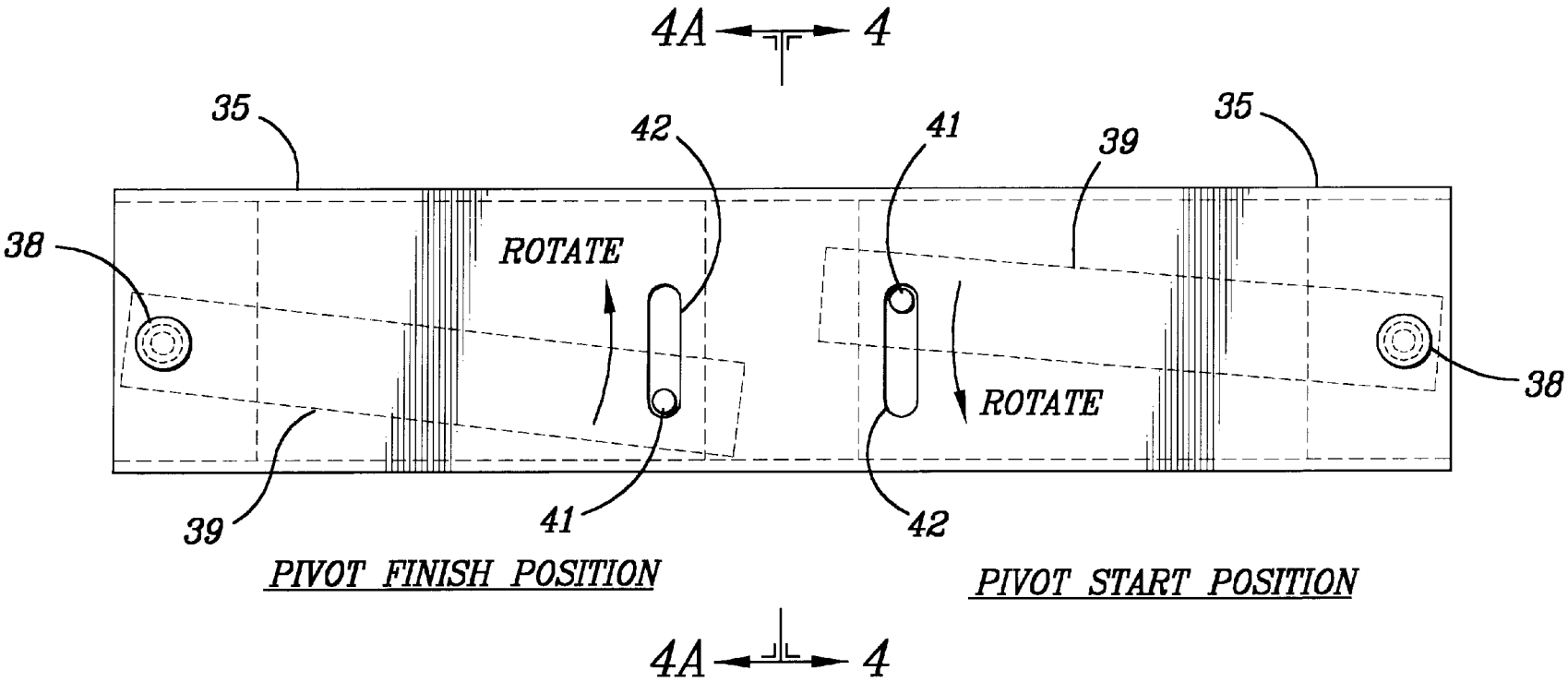
FIG. 3 is a plan view of the clamp frame assembly of the invention.
Figures 4, 4A:
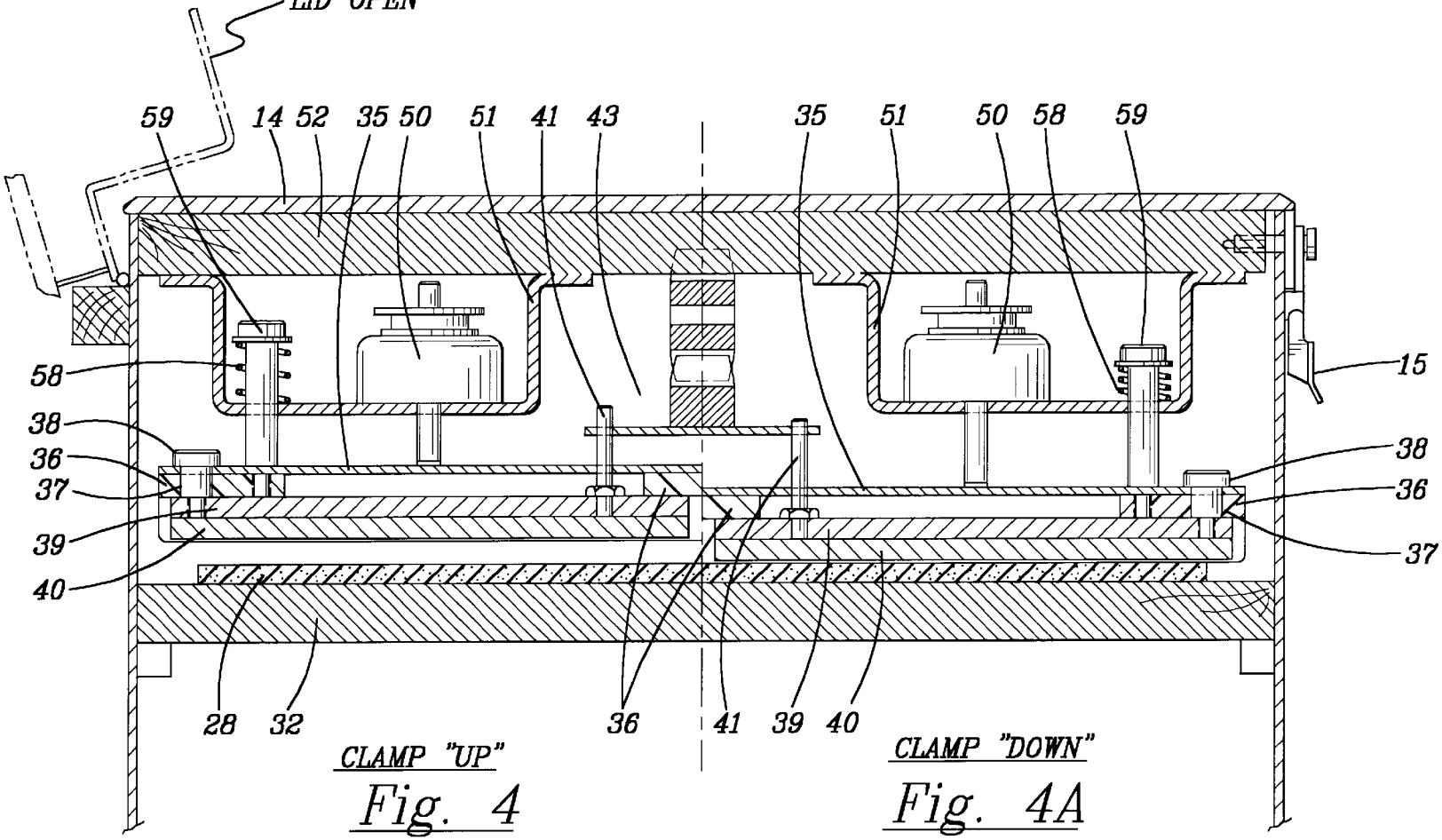
FIG. 4 is a vertical sectional view taken approximately on the Line 4—4 of FIG. 3 showing the clamp frame in up position.
FIG. 4A is a view similar to FIG. 4 showing the clamp frame in the engaged or down position.
Figure 5:
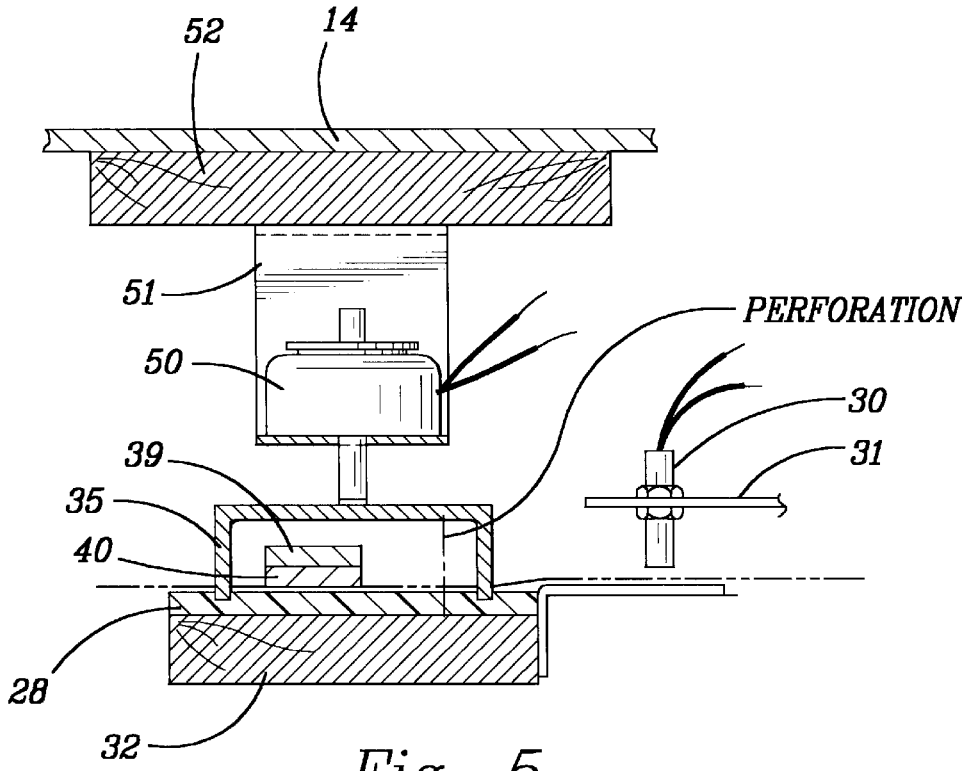
FIG. 5 is a vertical sectional view taken on the Line 5—5 of FIG. 8.
Figure 6:
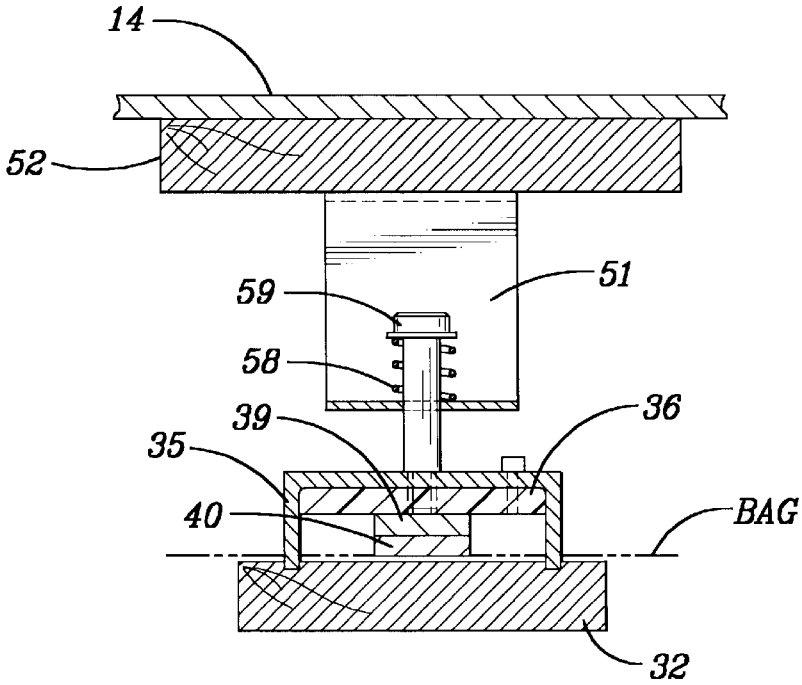
FIG. 6 is a vertical sectional view taken approximately on the Line 6—6 of of FIG. 8.
Figure 7:
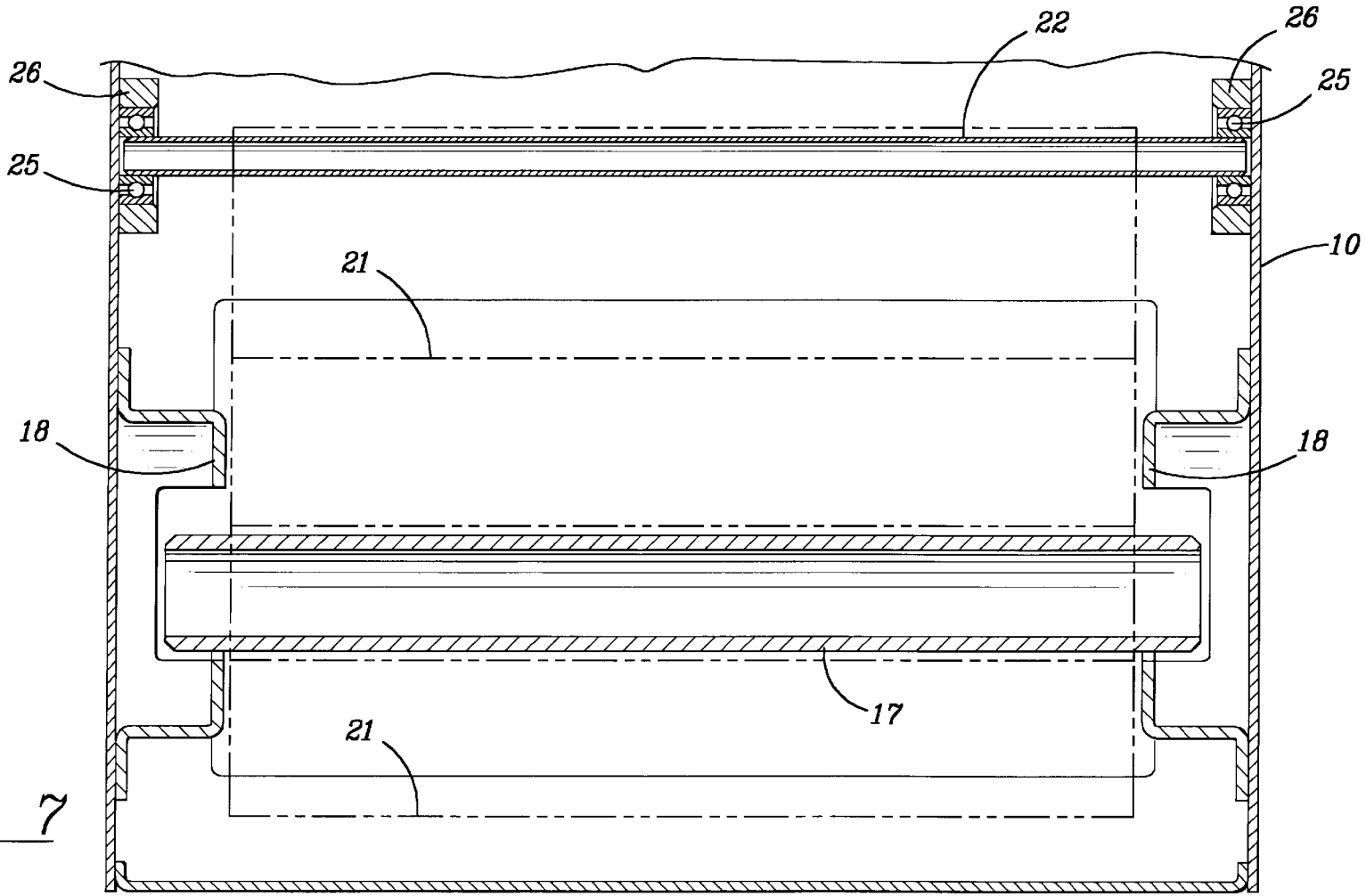
FIG. 7 is a horizontal sectional view taken approximately on the Line 7—7 of FIG. 2.
Figure 8:
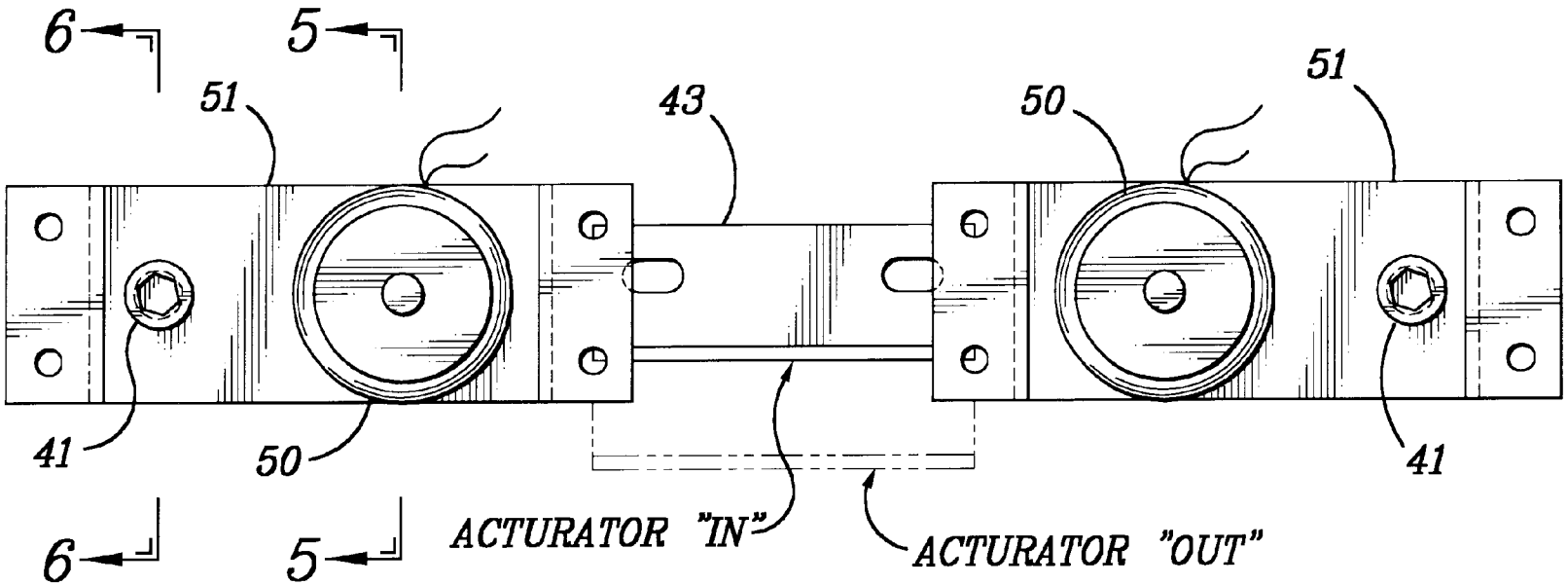
FIG. 8 is a plan of the solenoid and return spring hanger portion of the apparatus of the invention.
Figure 9:
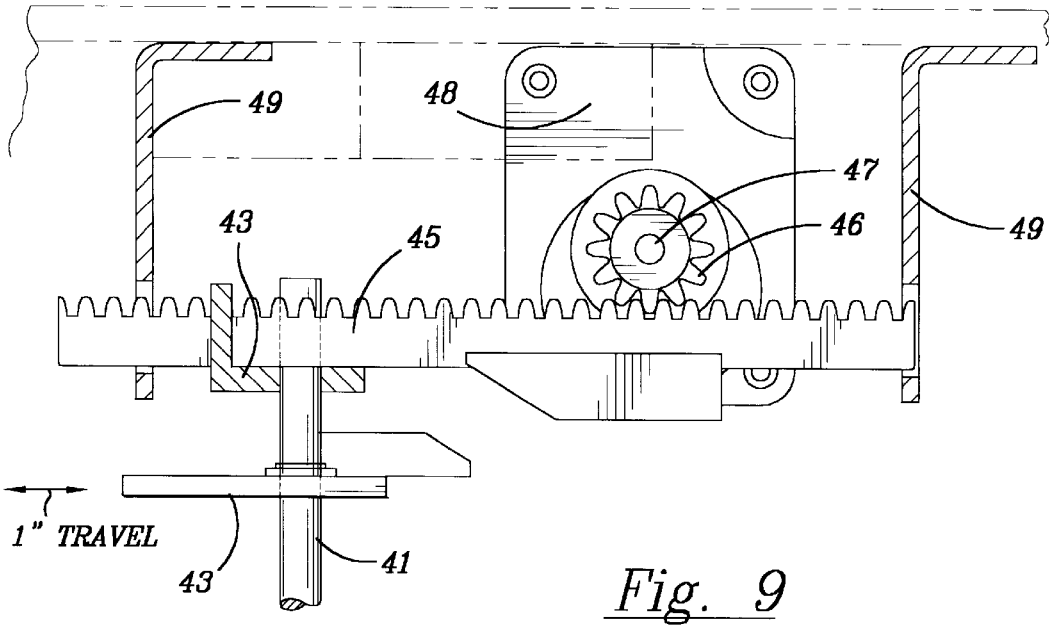
FIG. 9 is a fragmentary view of the adhesion interruption portion of the apparatus of the invention.
Figure 10:
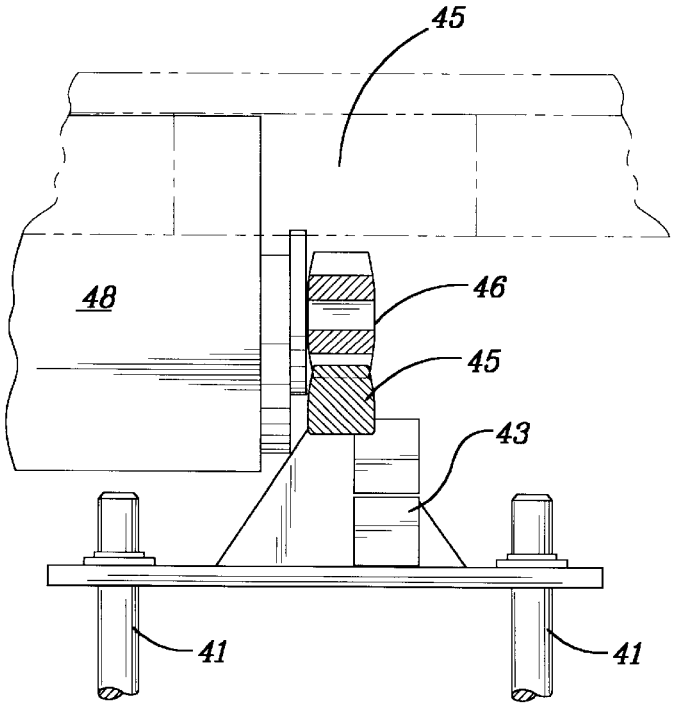
FIG. 10 is a fragmentary front view of the adhesion interruption portion of FIG. 9.
Figure 11:
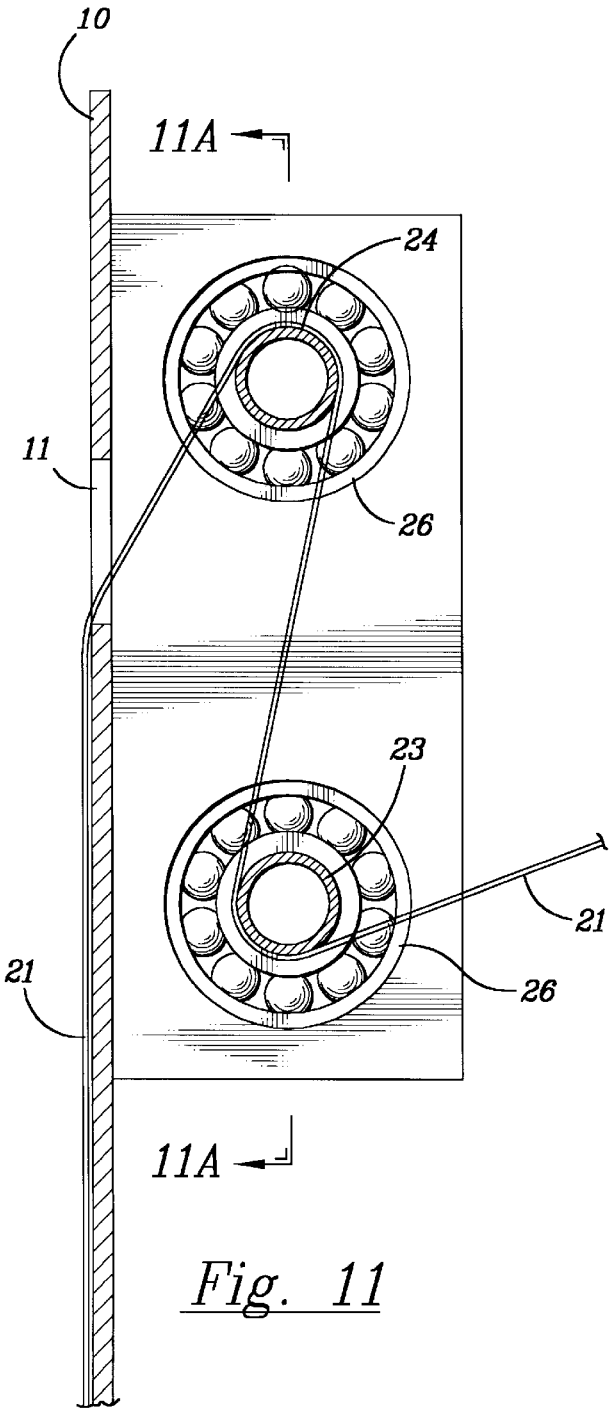
FIG. 11 is a fragmentary sectional view illustrating the roller bearing portion of the apparatus of the invention.
Figure 11A:
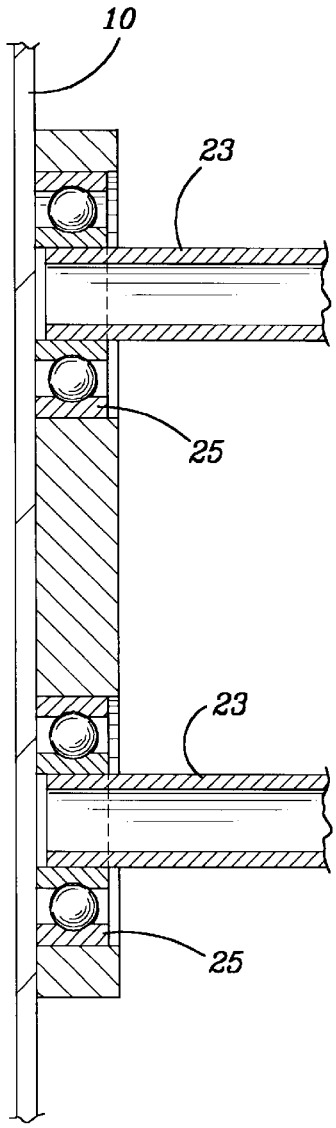
FIG. 11A is a vertical sectional view taken approximately on the line 11A—11A of FIG. 11.
Figure 12:
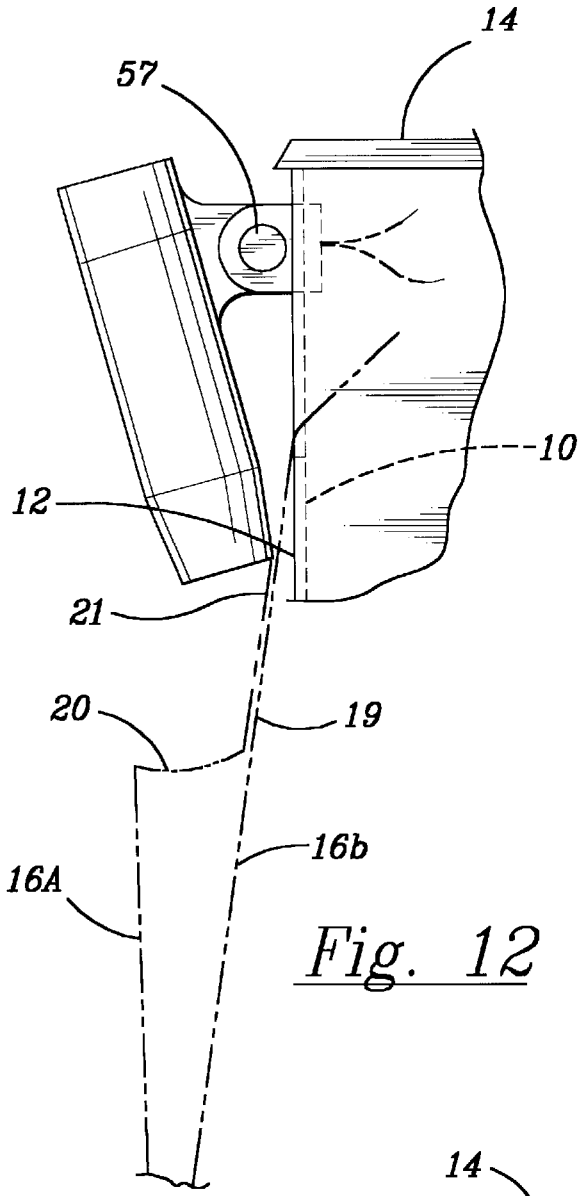
FIG. 12 is a side elevational view of the air blower portion of the apparatus of the invention.
Figure 13:
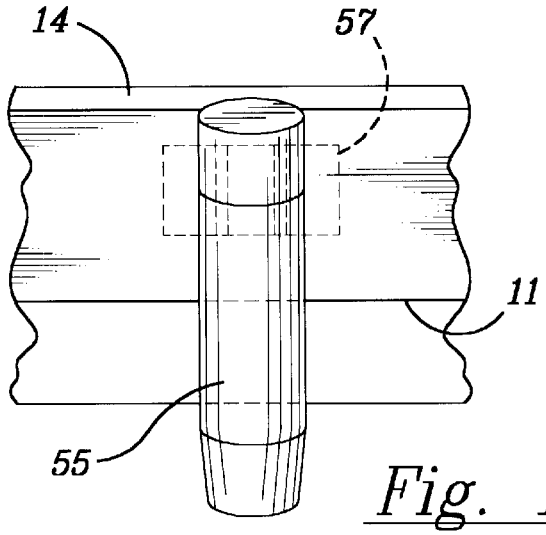
FIG. 13 is a front elevational view of the air blower of FIG. 12.
Figure 14:
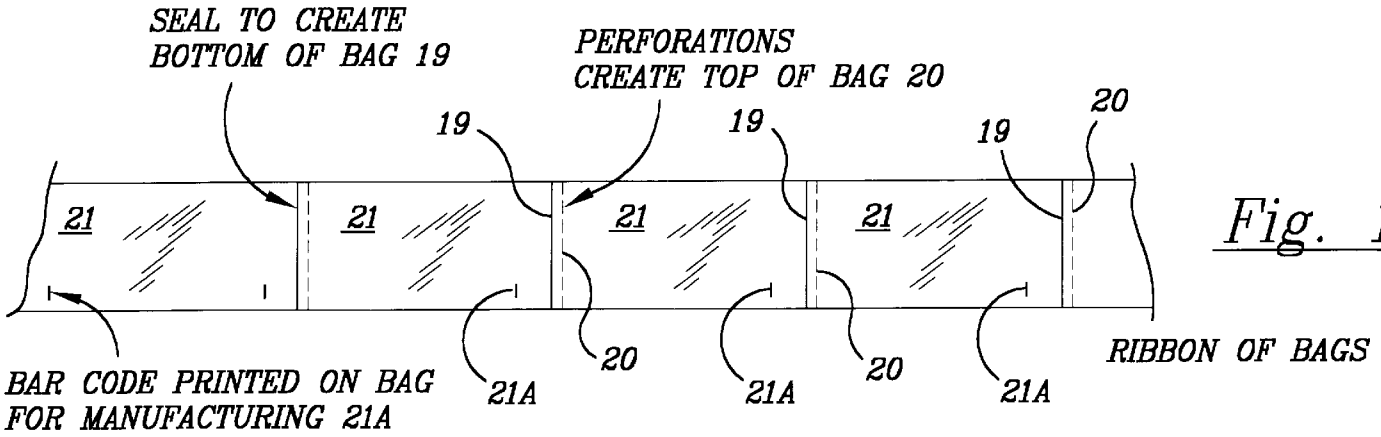
FIG. 14 is a plan view of a continuous length of plastic bags in tube form showing the seals and perforations that separate the bags, and the bar code for bag sensing.
Figure 14A:
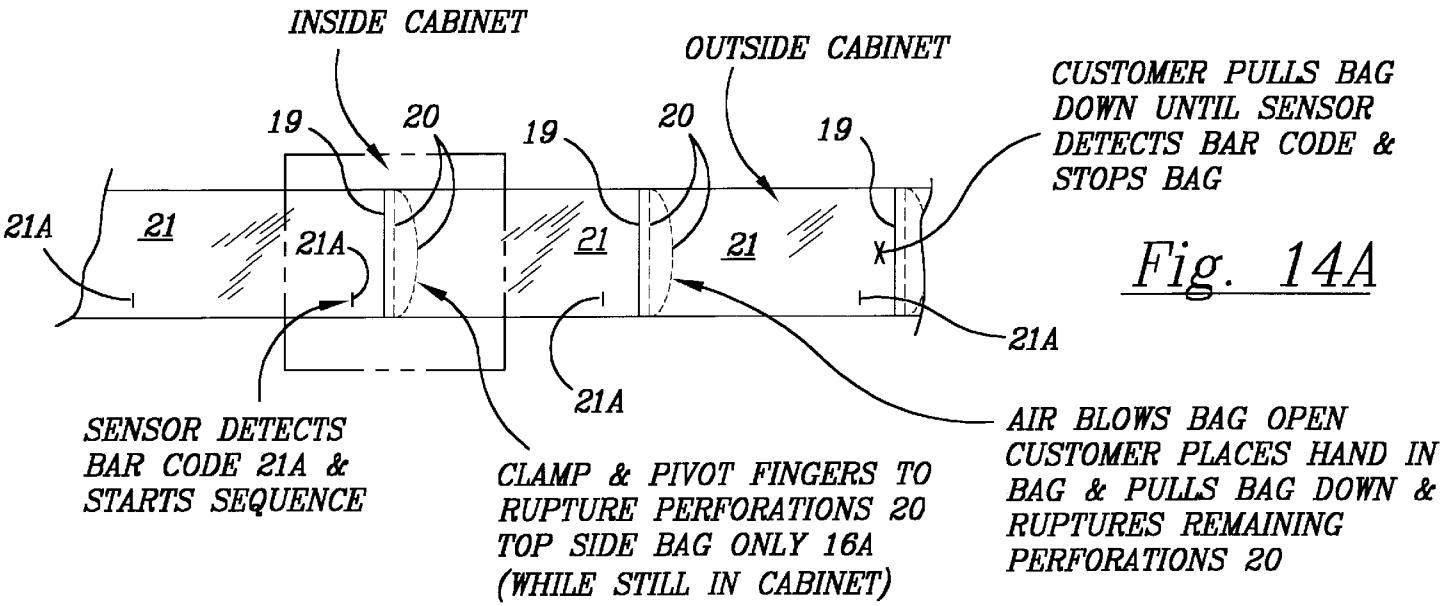
FIG. 14A is a plan view of the length of plastic bags, illustrating the operational sequence of dispensing and opening bags.
Figure 14B:
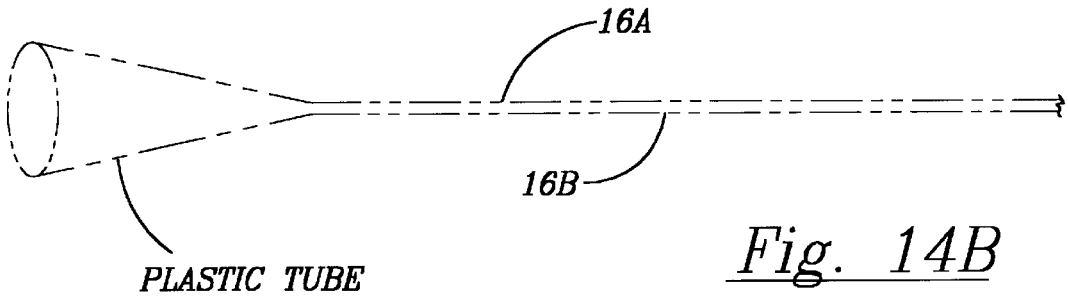
FIG. 14B shows a thin plastic tube flattened to form the top side and bottom side of a bag.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENTS

When referring to the preferred embodiments, certain terminology will be utilized for the sake of clarity. Use of such terminology is intended to encompass not only the described embodiment, but also technical equivalents which operate and function in substantially the same way to bring about the same result.

Referring now more particularly to the drawings, and FIGS. 1–14B inclusive, the apparatus includes an enclosure or cabinet 10, which is provided with a slot 11 in its front face 12, which is intended to have plastic bags pass therethrough, to be described. The cabinet 10 has a top lid 14, which is hinged at the left, and latched at 15 on the right side of cabinet 10.

A roll 16 of plastic bags is provided carried on a spindle 17, which is supported on two saddles 18 mounted in cabinet 10. To load the roll 16 spindle 17 is passed through roll 16 and placed on saddle 18 and pushed into its slot 18A. The roll 16 consists of a continuous ribbon of plastic bags wound on a spool with seal lines 19, and lines of perforations 20 to delineate the individual bags 21 to be separated, and with bar code indicia 21A thereon. The cabinet 10 has support rollers 22, 23, and 24, which are carried in roller bearings 25, which are mounted in blocks 26 and 27. The flattened plastic tube has a top layer 16A and a bottom layer 16B, which form plastic bags 21.

The ribbon of bags 21 in non-separated condition are threaded up over roller 22, across the top of a foam rubber pad 28, under a bottom roller 23, up over top roller 24, and out slot 11, so that the bottom of a bag 21 will hang down the outside front face 12, adjacent the bottom of cabinet 10.

A photo electric switch 30 is provided, mounted by bracket 31 to cabinet 10, which switch is a bar code reader capable of reading the bar code indicia 21A on the bags 21, which bar code indicia 21A was previously used in the manufacture of the bags to locate the seal lines 19, to create the bottom of bags 21, and the perforation lines 20 to locate the top end of bags 21. The bar code indicia 21A in conjunction with the switch 30 acts to determine the stop position and length of the bags 21 to be described.

The apparatus is provided with pre-opening bag mechanism located in cabinet 10, and includes a foam rubber pad 28 which is mounted on a platform 32, which extends across and is mounted to the sides of cabinet 10. The roller 22 supports the bags 21 as they travel over pad 28, preferably at a distance of ⅛ inch above the pad.

A clamp mechanism or frame 35 is provided, above the bags and carried on guide bolts 59, with return springs 58, and which bolts are engaged in brackets 51. The frame 35 is designed to clamp or engage a bag 21 with the foam pad 28, straddle the perforation lines 20, and hold the bag 21 for pre-opening.

The clamp frame 35 is a channel with three wear strips 36 mounted inside, one at each end and one in the middle. The wear strips 36 have holes 37 to accept shoulder screws 38, which are engaged with fingers 39 and pivot therewith. The fingers 39 may be fabricated of aluminum or plastic, with pads 40 of foam rubber attached thereto in any preferred manner, such as by adhesive of well known type.

The fingers 39 are intended to open the bags 21 to be described, and have shoulder bolts 41 engaged therewith, which are carried in slots 42 in clamp frame 35.

The shoulder bolts 41 are captured in a drive plate 43, which is attached to a rack 45, which is engaged with a pinion gear 46 mounted to a shaft 47 from a reversible motor 48, which is mounted to cabinet 10. The rack 45 is carried in L/shaped brackets 49, which are also mounted to cabinet 10.

The motor 48 is connected to switch 30 and moves drive plate 43 back and forth to pivot fingers 39.

Two solenoids 50 are provided, connected to switch 30, and mounted by brackets 51 to mounting plate 52 fastened to cabinet 10, and engaged with clamp frame 35 to move it down to clamp a plastic bag 21 to pad 28, and restrain it while the top end of the bag 21 is opened, to be described. A blower motor 55 is provided, which is also connected to switch 30 and is mounted to face 12 of cabinet 10 by bolt 56 and bracket 57.

The mode of operation will now be described. With the roll 16 of plastic bags 21 in the cabinet 10 and a bag 21 available at slot 11, the customer pulls down a bag 21' outside cabinet 10, whereupon the bar code indicia 21A from the next bag 21 inside cabinet 10 is detected by the bar code reader 30, which activates solenoids 50, which cause clamp frame 35 to move down and clamp the next bag 21 to pad 28, halting the travel of bag 21, and also briefly activating blower motor 55, which directs an air blast into bag 21' outside the cabinet to open it for use.

With the clamp frame 35 engaged with the next bag 21, the bag 21' is opened by the air blast and the customer can insert his or her fingers (not shown) therein and remove bag 21' for use.

With the next bag 21 firmly held to pad 28, motor 48 is activated and through gear 46 moves rack 45 which moves drive plate 43, which pushes shoulder bolts 41 in slot 42 and causes fingers 39 to rotate, and pads 40 to grip the top layer 16A of bag 21 only, and move it across the bottom layer 16B, which bottom 16B offers minimum resistance due to the slippery nature of the plastic film.

The movement of top layer 16A across the bottom layer 16B causes the adhesion of layers 16A and 16B to be interrupted, the line of perforations 19 in top layer 16A to rupture, and the line of perforations 19 in bottom layer 16B to remain intact. When rack 45 is fully extended solenoids 50 are deactivated, and clamp frame 35 is moved upwardly by return springs 58 on the guide bolts 59, which are engaged in the brackets 51.

When clamp frame 35 is moved to the up position, it activates motor 48, which causes rack 45 and drive plate 43 to move, and accordingly pivot fingers 39 return to their initial position.

The operation can be repeated as desired with the operational sequence initiated by the customer pulling a bag 21' out and down the face 12, until the bar code indicia 21A is read by bar code reader 30, and the operation begins.

Figure 15:
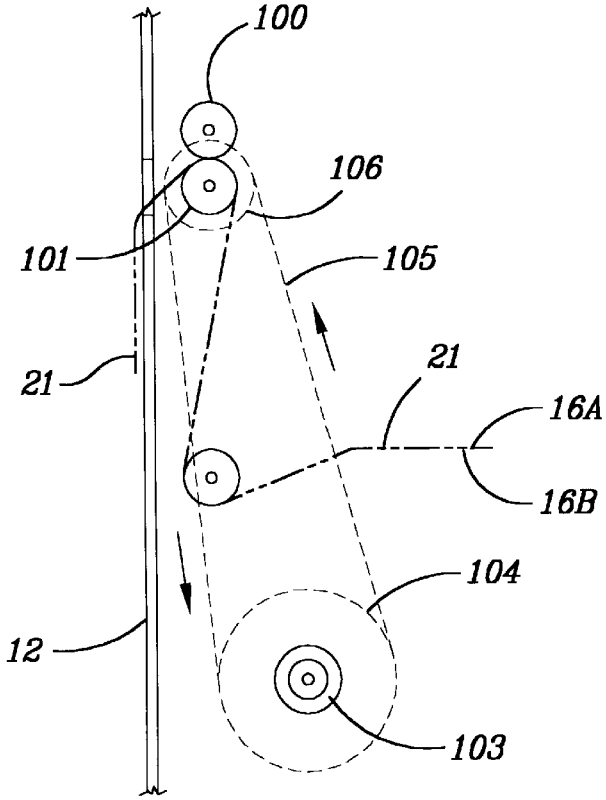
FIG. 15 is a side view of an alternate embodiment of the invention, which automatically dispenses the bags.

Referring additionally to FIG. 15, apparatus 100 for automatically dispensing bags 21 is illustrated.

Rollers 101 and 102 are added to the above described apparatus which feed the plastic bags 21. A drive motor 103 is provided which may be actuated by a well known switch (not shown) on the outside of the cabinet 10 at the touch of a customer.

The motor 103 has a drive gear 104 with a chain 105 engaged therewith, and with a drive gear 106, which is attached to and drives roller 101, which rotates and advances bag 21 until its bar code indicia 21 A is detected by bar code reader 30, which stops motor 103, the bag 21 is pre-opened, dispensed and fully opened as described above with the sequence initiated by the customer to dispense one bag at a time, upon actuation of the switch (not shown) by the customer.

It will thus be seen that apparatus has been provided with which the objects of the invention are attained.

We claim:

1. An apparatus for opening and dispensing plastic bags, which bags are formed from a continuous flattened plastic tube, which has a top layer and a bottom layer, which tube is wound on a roll with spaced bar code indicia, seal lines and perforation lines thereon delineating individual bags, and fed in the apparatus, comprising;

a cabinet;

roller transport means in said cabinet to carry said bags therein;

clamping means in said cabinet to selectively clamp said bags;

pre-opening bag means in said cabinet to selectively pre-open said bags in said cabinet one at a time;

bar code sensing means to sense bar code indica on said bags and actuate said clamping means and said pre-opening bag means;

said clamping means includes a clamp frame mounted on guide bolts above said length of bags, and solenoid means to move said frame into and out of contact with said length of bags upon receiving a signal from said bar code sensing means, said pre-opening means comprises a foam pad mounted in said cabinet in selective contact with said bottom layer of said bags; and under said clamp frame to selectively grip said bottom layer, a drive plate slidably attached to said frame a pair of fingers pivotedly attached to said drive plate, with pads thereon which are selectively engageable with said top layer of said bags to cause said top layer to move across said bottom layer and separate at said top layer perforation line, a gear driven rack attached to said drive plate for movement therefore, and a motor attached to said gear which is actuated by a signal from said bar code sensing means;

a slot in said cabinet to receive said bags from said roller transport means, means to provide said bags in front of said cabinet, and air supply means on said cabinet adjacent said slot to momentarily supply an air blast to fully open the ends of said bag in front of said cabinet.

2. Apparatus for opening and dispensing plastic bags as defined in claim 1 in which said roller transport means is manually actuated.

3. Apparatus for opening and dispensing plastic bags as defined in claim 1 in which said roller transport means is mechanically driven.

4. Apparatus for opening and dispensing plastic bags as defined in claim 1 in which said roll of bags is mounted exteriorly of said cabinet.

5. Apparatus for opening and dispensing plastic bags as defined in claim 1 in which said roll of bags is mounted inside said cabinet.

6. Apparatus for opening and dispensing plastic bags as defined in claim 1 in which drive motor means is provided to advance said roll of bags for bag indicia detection, and dispensing, and a manually operated switch is provided to activate said drive motor.

* * * * *